US007339130B2

(12) United States Patent
Ho

(10) Patent No.: US 7,339,130 B2
(45) Date of Patent: Mar. 4, 2008

(54) COMPOSITE SWITCH

(75) Inventor: Chin-Hsing Ho, Taipei (TW)

(73) Assignee: Altek Corporation, Hsinchu (TW)

( * ) Notice: Subject to any disclaimer, the term of this patent is extended or adjusted under 35 U.S.C. 154(b) by 0 days.

(21) Appl. No.: 11/605,276

(22) Filed: Nov. 29, 2006

(65) Prior Publication Data

US 2008/0000765 A1 Jan. 3, 2008

(30) Foreign Application Priority Data

Jun. 28, 2006 (TW) ..... 95123415 A

(51) Int. Cl.
*H01H 13/14* (2006.01)
*H01H 9/20* (2006.01)

(52) U.S. Cl. ..... 200/341; 200/520

(58) Field of Classification Search ..... 200/341
See application file for complete search history.

(56) References Cited

U.S. PATENT DOCUMENTS 5,134,259 A * 7/1992 Page, Jr. ..... 200/341
5,434,378 A * 7/1995 McLean ..... 200/537
5,999,084 A * 12/1999 Armstrong ..... 338/114
6,343,991 B1 * 2/2002 Armstrong ..... 463/37

* cited by examiner

*Primary Examiner*—Elvin Enad
*Assistant Examiner*—Lheiren Mae A. Anglo
(74) *Attorney, Agent, or Firm*—Birch, Stewart, Kolasch & Birch, LLP

(57) ABSTRACT

A composite switch is provided to output corresponding default signals through two different operation actions. The composite switch includes a housing, a pressing member, a sensor, a first pin, an electrical connection portion, and a metal spring leaf. The sensor is disposed in an accommodation portion of the pressing member to sense external changes and output a first signal through the first pin. The metal spring leaf selectively electrically contacts the electrical connection portion through pressing the pressing member and outputs a second signal.

3 Claims, 3 Drawing Sheets

COMPOSITE SWITCH

CROSS-REFERENCE TO RELATED APPLICATIONS

This non-provisional application claims priority under 35 U.S.C. § 119(a) on Patent Application No(s). 095123415 filed in Taiwan, R.O.C. on Jun. 28, 2006, the entire contents of which are hereby incorporated by reference.

BACKGROUND OF THE INVENTION

1. Field of Invention

The present invention relates to a composite switch, and more particularly to a composite switch which outputs two corresponding default signals through two different operation actions.

2. Related Art

Currently, electronic devices commonly seen in daily life or control equipments such as industrial processing equipments are all provided with a button input structure for controlling the above equipments. A conventional one-stage button structure is a spring-type press button. When a user press the spring-type button, the body of the button makes a tip thereof trigger an electrical switch by the spring force of the spring, such that the electronic device can perform the default function of the electrical switch. After releasing the button, the button will return to its original position by the use of the characteristic of elastic recovery. Additionally, the sensor can function as the one-stage switch, and for example, a light sensor, a vibration sensor, a photoelectric sensor, etc. can function as non-contact switch.

A common digital camera, for example, employs a two-stage switch as a button to execute the functions of focusing and shooting. When pressing the two-stage switch half way to a first-stage switch, a capturing image is focused. After finishing focusing and clearly catching the image, fully press the two-stage switch to a second-stage switch, and thus a digital camera captures the focused image.

A conventional button switch of the digital camera is a two-stage switch combining the focus function and shutter function as a whole, so as to perform focusing and shooting in sync. Thus, the space for accommodating control switches can be reduced. However, in order to satisfy the market requirements of light and thin electronic devices such as digital cameras, the travel from the first-stage switch to the second-stage switch cannot be large, thus leading to an excessively high sensitivity. When pressing the two-stage switch, the force exerted by individual users and the tact of individual users are different, action errors easily occur, and the second-stage switch may be mistakenly triggered. It is uneasy for the users incapable of accurately controlling force and tact to operate with the two-stage switch.

Since the user cannot correctly execute the default functions of the first-stage switch and the second-stage switch unless applying different pressing force to the conventional two-stage button, the user cannot execute the default function of the first-stage switch due to the improper pressing force or may mistakenly press to a second-stage switch without finishing the pressing of the first-stage switch. The conventional two-stage switch incurs the difficulty in controlling pressing force, and is also inconvenient in use.

SUMMARY OF THE INVENTION

In view of the above-mentioned problems, the present invention provides a composite switch to overcome the limitations or defects that the user cannot easily control the force of pressing the two-stage switch, and thus the default functions of a first-stage switch and a second-stage switch cannot be correctly executed, thereby causing action errors.

The composite switch disclosed by the present invention is capable of outputting two default signals through two different operation actions, and comprises a housing, a pressing member, a sensor, a first pin, an electrical connection portion, and a metal spring leaf. The housing has an accommodation space and an opening. The pressing member is disposed at the opening and is capable of moving in the accommodation space. The pressing member has an accommodation portion inside, and the sensor is disposed in the accommodation portion for sensing external changes and outputting a first signal. The first pin is disposed in the accommodation portion and is electrically connected to the sensor. The electrical connection portion is disposed in the accommodation space of the housing, and has a contact and at least one second pin extending from the contact. A metal spring leaf disposed in the electrical connection portion selectively electrically contacts the contact through pressing the pressing member, such that the electrical connection portion outputs a second signal.

The present invention has the efficacy of using the sensor as the first-stage switch and using the one-stage button as the second-stage switch. As such, the user can correctly execute the default function of the first-stage switch and the second-stage switch without controlling pressing force, thus avoiding inconvenience of action errors existing in the conventional two-stage switch.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

In the following detailed illustration of the present invention, an injection device is taken as an application embodiment of the composite switch of the present invention. However, it is apparent that the accompanying drawings are provided for reference and illustration, and are not intended to limit the scope of the present invention.

Figure 1:
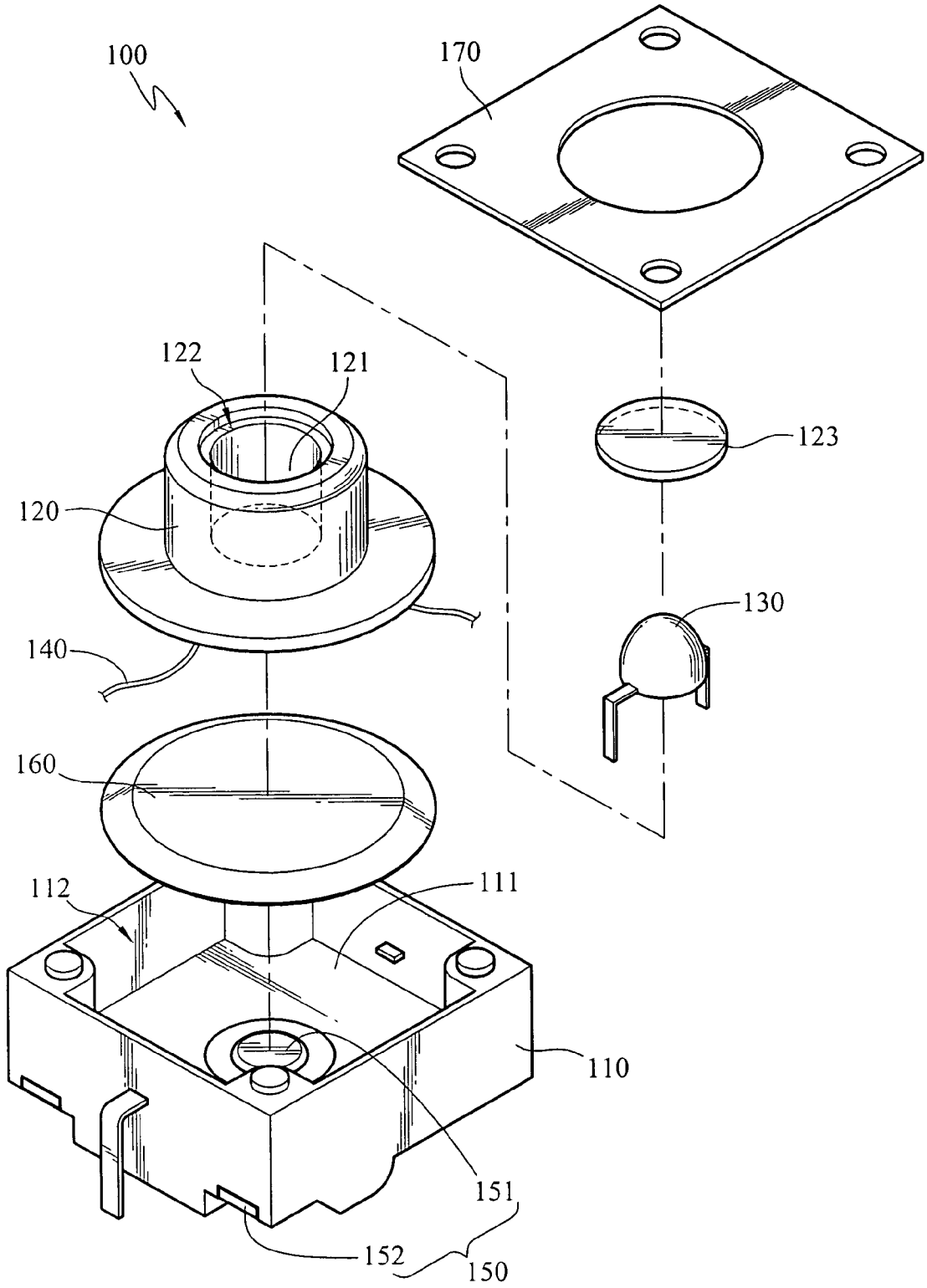
FIG. 1 is a schematic exploded view of the present invention.

FIG. 1 is a schematic exploded view of the present invention. As shown in the figure, a composite switch 100 disclosed by the present invention is applicable in an injection device (not shown). The composite switch 100 outputs two default signals through two different operation actions, and executes the default actions of the injection device. The composite switch 100 of the present invention comprises a housing 110, a pressing member 120, a sensor 130, a first pin 140, an electrical connection portion 150, and a metal spring leaf 160. The housing 110 has an accommodation space 111 and an opening 112. The pressing member 120 is disposed in the opening 112 of the housing 110 and can move within the accommodation space 111. The pressing member 120 has an accommodation portion 121 inside for accommodating the sensor 130. One end of the first pin 140 is disposed in the accommodation portion 121 and is electrically connected to the sensor 130, and the other end is exposed outside the housing 110 and is electrically connected to the injection device. The sensor 130 is used to sense the external changes of the composite switch 100 and outputs a first signal to the injection device, i.e., executes the action of filling liquid. The electrical connection portion 150 is disposed in the accommodation space 111, and has a contact 151 located in the accommodation space 111 and at least one second pin 152 extending from the contact 151. The second pin 152 is exposed outside the housing 110 and is electrically connected to the injection device. The metal spring leaf 160 is disposed between the contact 151 and the pressing member 120 and selectively electrically contacts the contact 151 through pressing the pressing member 120, such that the electrical connection portion 150 outputs a second signal to the injection device, i.e., executes the default action of injecting liquid.

Please refer to FIG. 1, the composite switch 100 further comprises a fixing member 170 fitted on the pressing member 120. The fixing member 170 is fixed at the opening 112 of the housing 110 to confine the moving of the pressing member 120 in a specific range in the accommodation space 111. As such, the pressing member 120 can correctly push the metal spring leaf 160 to electrically contact the contact 151, thus conducting a circuit while outputting the second signal, such that the injection device starts injecting liquid.

Figure 2:
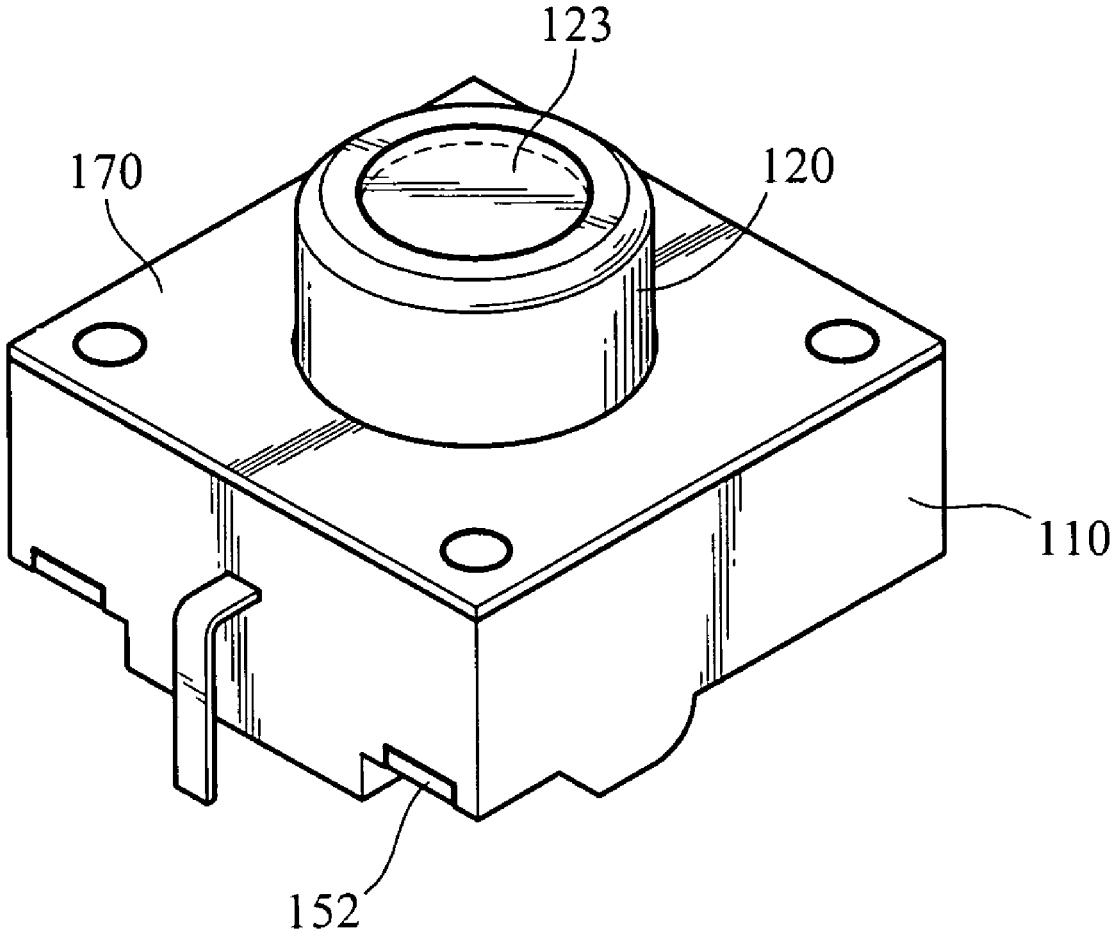
FIG. 2 is a schematic stereogram of the present invention.

As shown in FIGS. 1 and 2, the sensor 130 is a pyroelectric IR sensor capable of sensing infrared rays emitted from human bodies. When sensing infrared rays from human bodies, the sensor 130 will generates a signal change to execute the default action of filling liquid. Additionally, the housing of the pressing member 120 is further opened with a through hole 122 corresponding to the sensor 130, for the convenience of the user to press at a corresponding position of the sensor 130. Additionally, in order to protect the sensor 130 from being contaminated by dirty dust which may influence sensitivity, and prevent liquid flowing into the pressing member 120 through the through hole 122 to cause short circuit of the electronic parts of the sensor, a transparent cover 123 is embedded in the through hole 122. The material of the transparent cover 123 can be transparent materials, such as acryl or glass, which will not degrade the sensing efficiency of the sensor 130.

Figure 3:
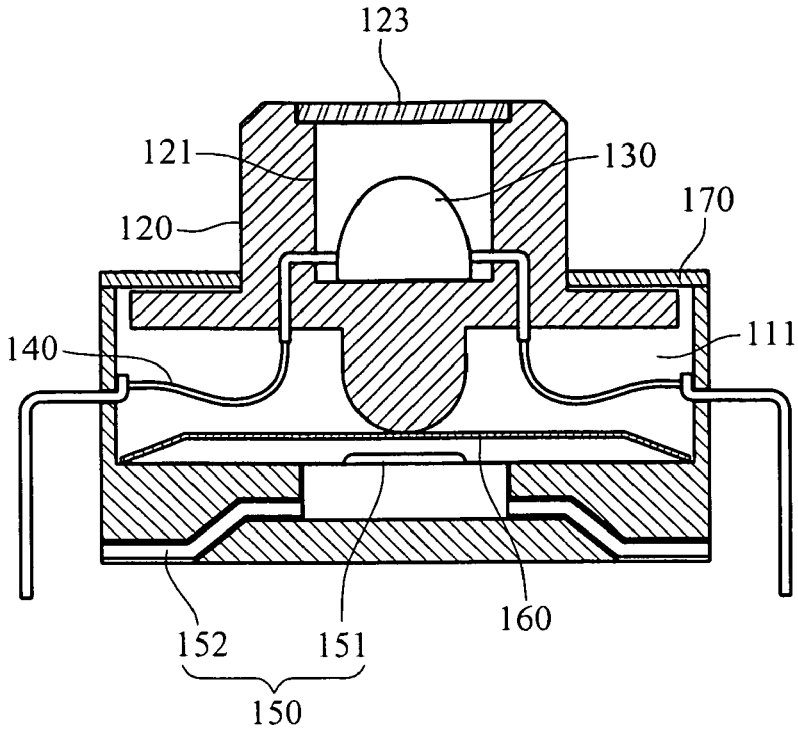
FIG. 3 is a schematic sectional view of the present invention.
Figure 4:
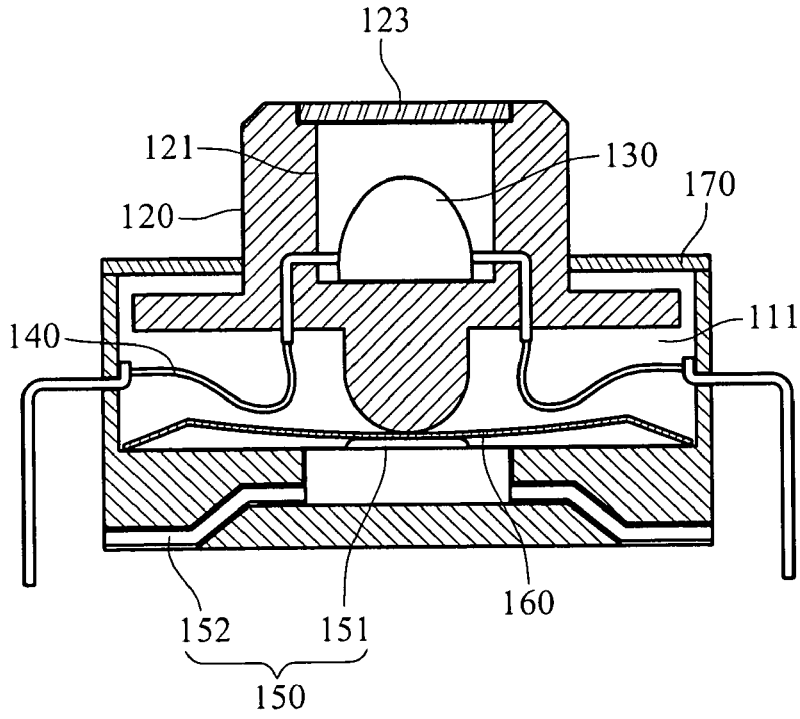
FIG. 4 is a schematic sectional view of the metal spring leaf electrically contacting the contact of the present invention.

Referring to FIG. 3 and FIG. 4, the sensor 130 is normally electrically connected to the injection device through the first pin 140. Once the finger of the user touches the corresponding position of the sensor 130, the sensor 130 outputs the first signal to make the injection device execute the action corresponding to the first signal. Once the user presses the pressing member 120 and pushes the metal spring leaf 160 to electrically contact the contact 151, and the contact 151 outputs the second signal to the injection device through the second pin 152, the default action corresponding to the second signal is execute.

It should be noted that the first signal output by the sensor disclosed by the present invention relates to executing the default action of filling liquid, and the second signal output by the electrical connection portion relates to executing the default action of injecting liquid. Those skilled in the art can alternate the design of the default function of the two signals to require a two-stage switch to perform operation, and the present invention is not limited to the embodiments of the present embodiment.

Compared with the conventional art, the composite switch disclosed by the present invention can be operated more conveniently and rapidly and can perform the default function correctly, so as to prevent the user from operating by mistake due to inappropriate depressing force.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A composite switch, for outputting two default signals through two different operation actions, comprising:

a housing, having an accommodation space and an opening;

a pressing member, disposed at the opening and capable of moving in the accommodation space, said pressing member having a accommodation portion inside the pressing member, and a through hole and a transparent cover embedded in the through hole;

a sensor, disposed in the accommodation portion for sensing external change outside the transparent cover to output a first signal;

an electrical connection portion, disposed in the accommodation space; and a metal spring leaf, disposed in the accommodation space, said metal spring leaf electrically contacting the electrical connection portion when the pressing member is pressed such that said electrical connection portion outputs a second signal.

2. The composite switch as claimed in claim 1, further comprising a fixing member fitted on said pressing member and fixed on said housing, for confining the moving of said pressing member in a specific range in the accommodation space.

3. The composite switch as claimed in claim 1, wherein the sensor is a pyroelectric IR sensor.

* * * * *